United States Patent [19]

Dalo et al.

[11] Patent Number: 4,887,626

[45] Date of Patent: Dec. 19, 1989

[54] STRETCHED CLOTH FIXING DEVICE

[76] Inventors: Pierre Dalo, Z.I. du Bel-Air - Rue P. Métairie, 78120 Rambouillet; Jean Dalo, 1, rue Beaurepaire, 91410 Roinville-sur-Dourdan, both of France

[21] Appl. No.: 150,398

[22] Filed: Jan. 29, 1988

[30] Foreign Application Priority Data

Jan. 30, 1987 [FR] France ..... 87 01157

[51] Int. Cl.[4] ..... E04B 1/347; A44B 21/00

[52] U.S. Cl. ..... 135/119; 135/DIG. 5; 52/222

[58] Field of Search ..... 135/119, DIG. 5; 52/203, 222

[56] References Cited

U.S. PATENT DOCUMENTS

| | | | |
|---|---|---|---|
| 3,462,901 | 8/1969 | Jamgochian | 52/316 |
| 3,719,341 | 3/1973 | Harrington | 52/222 |
| 3,811,454 | 5/1974 | Huddle | 135/102 |
| 3,909,994 | 10/1975 | Richter | 135/119 |
| 4,112,643 | 9/1978 | Decker | 52/222 |
| 4,153,981 | 5/1979 | Stuppy | 24/243 K |
| 4,170,810 | 10/1979 | Peleg | 52/222 |
| 4,274,234 | 6/1981 | Abell | 52/222 |
| 4,682,618 | 7/1987 | Zwick | 135/119 |

FOREIGN PATENT DOCUMENTS

| | | | |
|---|---|---|---|
| 1192799 | 5/1965 | Fed. Rep. of Germany | 135/119 |
| 2908971 | 9/1980 | Fed. Rep. of Germany | 135/119 |

*Primary Examiner*—David A. Scherbel
*Assistant Examiner*—Caroline D. Dennison
*Attorney, Agent, or Firm*—McAulay Fisher Nissen & Goldberg

[57] ABSTRACT

A device for securing the edge of a stretched sheet, applicable more particularly to securing the lower edge of a tent canvas of a light shelter of a general pyramidal shape, has a horizontal extruded section with a groove opening, in one of its vertical faces, through an inlet slit of a width less than that of the bottom of the groove. A locking rod is able to be engaged transversally in the groove, through its inlet slit, and to be immobilized therein so as to retain the edge of the sheet having a bead. The locking rod, in the locked position, is in a vertical position at right angles with respect to its position of insertion in the groove and it is jammed against the lower lip by a lower rounded part, joining together the internal and external faces of the rod, so that a tractive force exerted outwardly on the sheet does not allow the bead to escape from the groove.

16 Claims, 3 Drawing Sheets

STRETCHED CLOTH FIXING DEVICE

BACKGROUND OF THE INVENTION

The present invention relates to devices for securing the edge of a stretched sheet and is applicable more particularly to securing the lower edge of a tent canvas of a light shelter of a general pyramidal shape, as well as a light shelter of this type having such a canvas securing device.

Light shelters are known having a metal supporting structure on which a tent canvas of general pyramidal shape is secured and stretched. The base of the pyramid formed by the stretched canvas is generally fixed to the structure by means of a lacing member passing through eyelets fixed to the lower edge of the canvas and secured to the metal supporting structure. Such a method of fixing has the obvious drawback of providing such fixing only at spaced apart points, which adversely affects the resistance of the canvas covering.

For fixing the lower edge of the canvas a relatively rigid beading can also be provided on two parallel sides of this edge, and the two parallel beadings are slid into longitudinal grooves formed in extruded light alloy sections. Each groove opens to the outside through a relatively narrow slit, through which only the canvas may pass so that each bead is thus held in the groove of a section once introduced therein through one of its ends.

Other devices are also known for fixing a canvas in an extruded section having a longitudinal groove, by transverse engagement of this canvas in the groove. Such a device is described for example in the U.S. Pat. No. 3,811,454. This device has a horizontal extruded section with a groove opening into one of its vertical faces through an inlet slit of a width less than that of the bottom of the groove and a locking rod being engageable transversally in the groove through its inlet slit and being immobilized therein so as to retain the edge of the sheet having a bead. The inlet slit of the groove of the section is defined by a first upper lip of small height and a second lower lip of great height, these two lips thus defining, therebehind and on each side of the inlet slit respectively, on the side of the first upper lip, a first shallow channel and on the side of the second lower lip a second deeper channel. The locking rod has a thickness less than the width of the inlet slit so that it can be inserted in the groove. It comprises a rib which is jammed in the locked position in the first channel, the sheet and the bead then being jammed in the second channel and the locking rod extends between the bead and the sheet housed in the second channel, on the one hand, and the first channel on the other. The locking rod which is inserted in the groove of the extruded section in the horizontal position and which remains in this position when locked, then bears by the upper part of its external face against the internal face of the upper lip of the groove, but by a flat face opposite this face against the upper face of the lip via the locked sheet. Such a canvas fixing device, although it has the advantage of being convenient to use because the canvas is inserted transversally into the groove of the section, is however not suitable for applications in which the canvas is subjected to very high tensile forces, as is the case for a tent canvas of a light shelter currently constructed. In fact, when the locked sheet is subjected to a high pulling force, this force may cause the sheet and the rod to be pulled out of the section.

SUMMARY OF THE INVENTION

The present invention overcomes these drawbacks by providing a securing device of particularly simple design able to withstand very high forces.

For this, in the device of the invention, when the locking rod is in the locked position it is in a vertical position at right angles to its insertion position in the groove and it is jammed against the lower lip by a lower rounded portion, joining together the internal and external faces of the rod so that a tractive force exerted outwardly on the sheet does not allow the bead to come out of the groove.

Because of this arrangement, the tractive force exerted on the sheet, through the bead and the locking rod, jam the sheet against the two lips of the groove. Thus, when this tractive force increases, the sheet is jammed with a greater and greater force in the groove instead of risking coming out.

BRIEF DESCRIPTION OF THE DRAWINGS

One embodiment of the present invention will be described hereafter by way of non limitative example with reference to the accompanying drawings in which.

DESCRIPTION OF THE PREFERRED EMBODIMENT

Figure 1:
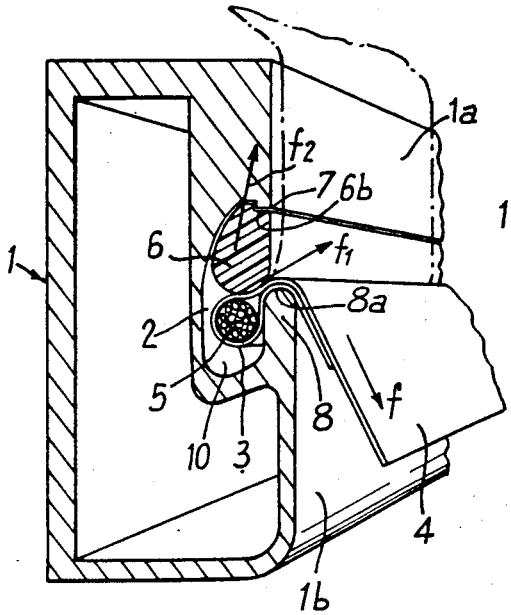
FIGS. 1 and 3 are partial perspective views in vertical section of a device for fixing the edge of a canvas in accordance with the invention respectively in the locked position, in an intermediate position between the locked position and the unlocked position and in the unlocked position.

The device for securing the edge of a canvas in accordance with the invention, which is shown in FIGS. 1 to 4, includes a fixed extruded section 1, made from a light alloy, of a substantially rectangular solid or hollow cross section which has, in its large external vertical face, a horizontal and longitudinal groove 2 of a curved and downwardly extending cross section. This groove is defined between two upper 1*a* and lower 1*b* external vertical faces offset horizontally with respect to each other, the lower vertical face being situated more towards the outside than the upper vertical face 1*b*. Groove 2 receives and immobilizes an edge 3 of a stretched sheet 4 which may for example be a tent canvas of a light shelter. Edge 3 of the sheet is formed by a bead produced by folding sheet 4 back on itself, so as to enclose a flexible rod 5. This flexible rod 5 may be formed by a cable of plastic threads housed in an external sheath or by a solid plastic material rod. Bead 3 forming the edge of the sheet is held immobile in groove 2 by a semirigid locking rod 6 which may for example be made from extruded polyvinyl chloride. Groove 2, in which bead 3 is housed, opens to the outside, at its upper lateral part, through a longitudinal slit of a width smaller than the width of the bottom of groove 2. This inlet slit of groove 2 is defined between an upper lip 7 of small height and a lower lip 8 of greater height which are formed in the section 1 during extrusion thereof. The upper lip 7 of small height ends in a lower front face 7*a* and, rearwardly of this upper lip 7 there extends a first shallow longitudinal channel 9. Face 7*a* and channel 9 form a first internal step 9*a*. This channel 9 is connected to a curved face 2*a*, with outwardly turned concavity, which forms the upper part of the bottom of groove 2 and it is extended downwardly by a substantially vertical flat face 2*b*. This flat vertical face 2*b* is joined to a lower face 2*c* of groove 2 which is itself connected to the inner face of the large upwardly extending lower lip 8. The vertical flat face 2*b*, the lower face 2*c* and the inner face of the large lower lip 8 define a second deeper channel 10 for receiving the bead 3.

The semirigid locking rod 6 has, in cross section, a shape complementary to that of the upper part of groove 2. In other words, it has a flat external face 6*a* which is coplanar with the upper external face 1*a* of the extruded section 1 in the locked position (FIG. 1) then an upper horizontal front face 6*b* bearing against the front face 7 of the small upper lip 7 then a rib 6*c* engaging in the first channel 9, then a curved internal face 6*d* mating substantially with the shape of the curved face 2*a* of groove 2 and finally a lower rounded face 6*e* joining together the external 6*a* and internal 6*d* faces.

The height of the external face 6*a* of the locking rod 6 is slightly less than the width of the inlet slit of groove 2 so that in the locked position (FIG. 1) this external face 6*a* does not completely close the inlet slit of groove 2. Only a small passage remains at the lower part, between the locking rod 6 and the lower large lip 8, through which passage sheet 4 extends which has, in this position, a double thickness because of the formation of bead 3 forming its edge. Furthermore, the total height between rib 6*c* and the lower face 6*e* of the locking rod is greater than the width of the inlet slit of the groove.

Figure 2:
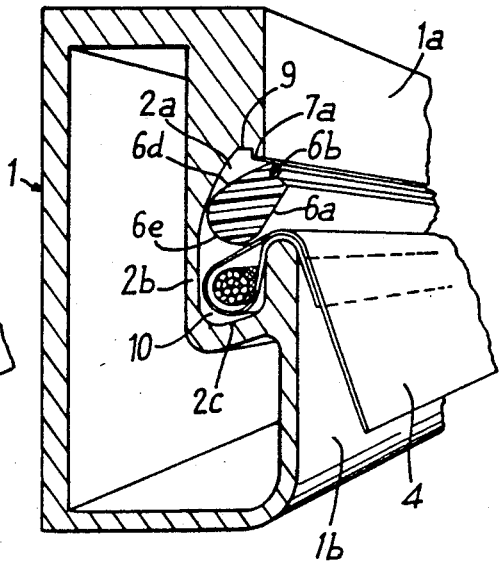
Figure 3:
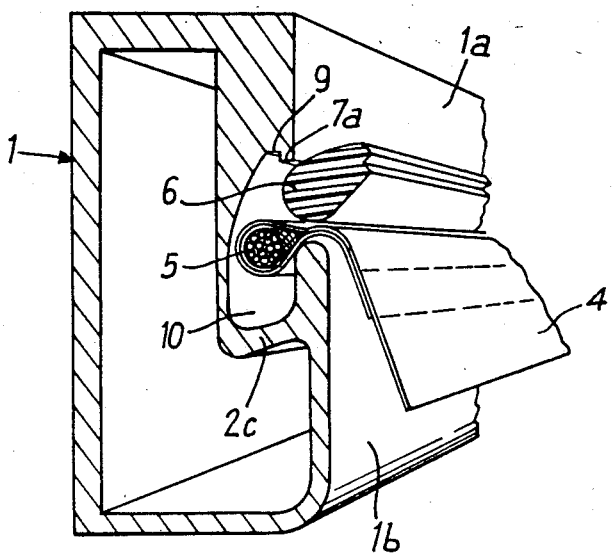
Figure 4:
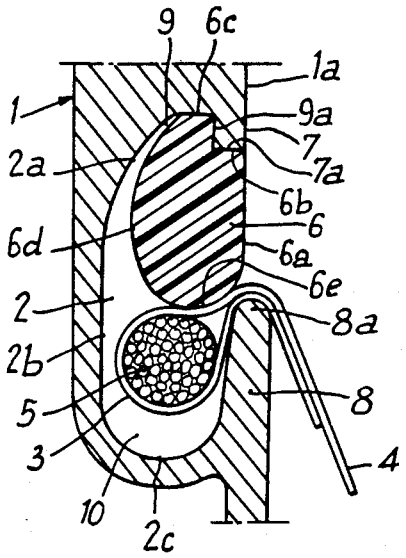
FIG. 4 is a partial vertical and cross sectional view, on a larger scale, of the groove and of the locking rod in the locked position.

In the non limitative embodiment of the invention shown in FIGS. 1 to 3, sheet 4 extends from outside the extruded section then downwards while passing over the upper rounded edge 8*a* of the lower lip 8. Sheet 4 is thus deflected substantially by 90° and it extends downwardly not only outside section 1 but also inside groove 2. Bead 3 is situated, in the locked position (FIG. 1), in the second groove 10 under the locking rod 6 which is in a vertical position, at right angles with respect to its insertion position in groove 2. In this position, its external face 6*a* is aligned with the upper external face 1*a* of section 1, its upper rib 6*c* is engaged in the first channel 9 of groove 2 and its curved internal face 6*d* is also in a vertical position. The lower face 6*e* of the locking rod 6 is then slightly lower than the upper edge 8*a* of the lower lip 8. If sheet 4 is subjected to a considerable downwardly directed tractive force, such as illustrated by arrow F, in FIG. 1, this force is transmitted to the bead 3 housed in the second channel 10 of groove 2 and this bead 3 is drawn upwardly and outwardly in the direction shown by arrow f1. It is however prevented from coming out of groove 2 because it is jammed between the lower face 6*e* of the locking rod 6 and the lower lip 8. The locking rod 6 is in its turn urged upwardly by bead 3 and it is applied against the small upper lip 7 defining the first channel 9 while exerting a force f2 thereon. It is thus jammed between the small upper lip 7 and the large lower lip 8 via sheet 4, and it retains the edge 3 of the sheet in the second lower chanel 10. Consequently, whatever the intensity of the force exerted on sheet 4, bead 3 cannot escape from groove 2, the tractive force exerted on sheet 4 being transferred by bead 3 to the locking rod 6 and by this latter to the extruded section 1. The locking rod 6 is therefore pushed all the more firmly against the upper lip 7 in groove 9, on the one hand, and against the lower lip 8, on the other hand, the higher the tractive force f exerted on sheet 4.

FIG. 2 illustrates the intermediate positions occupied by the locking rod 6 and bead 3 during securing of canvas 4 or release of this canvas. In this latter case, with canvas 4 then slackened, bead 3 which is free in the second lower channel 10 of groove 2, must be slightly lowered in this channel 10 so as to allow release of the locking rod 6. For this, the depth of channel 10 must be sufficient to allow this movement. The locking rod 6, after being slightly lowered so as to free its rib 6*c* from the first channel 9, is turned slightly on itself so as to bring its upper rib 6*c* into the inlet slit of groove 2 then outside thereof. From this moment, a tractive force exerted outwardly makes it possible to remove the locking rod 6 completely from groove 2, as illustrated in FIG. 3. Naturally, so as to permit engagement of the locking rod 6 in groove 2 and removal thereof from this groove, the maximum thickness of rod 6, that is to say the thickness of its lower part 6*e*, must be less than the width of the inlet slit of groove 2.

The operation for securing sheet 4 to the extruded section 1 is also very easy to carry out. In the first place it is sufficient to insert sheet 4 and bead 3 transversally, through the inlet slit, into groove 2, as is shown in FIG. 3, then to engage the locking rod 6 in this same groove 2, through the inlet slit, above the bead 3, by presenting first its lower face 6*e* of greater thickness then in the vertical position. Then the locking rod 6 is pushed progressively into groove 2, all along the section 1, in the horizontal direction, that is to say perpendicularly to the external face 1*a* of section 1. The locking rod 6 then extends horizontally, i.e. perpendicularly to its locked position in groove 2. Then the locking rod 6 is engaged horizontally until its lower face 6*e*, then in the front vertical position, comes into contact with the curved face 2*a* of groove 2. By further pushing the locking rod 6 horizontally, its face 6*e* slides progressively downwards over the curved face 2*a* of groove 2 which serves for guiding it. This results in causing bead 3 to descend into the second channel 10 and, at the end of insertion travel, in causing the locking rod 6 to pivot on itself, so as to bring it into a vertical position in which it is locked by its rib 6*c* in the first channel 9 and against the front face 7*a* of the upper lip 7, and by its lower face 6*e* bearing on the sheet 4 and bead 3 in the second channel 10 and against the lower lip 8. Thus, the locking rod 6 bears, in the locked position by the upper part of its external face 6*a* against the internal face of the upper lip 7 and it bears, by the lower part of this same external face 6*a*, against the internal face of the lower lip 8 of groove 2.

Figure 5:
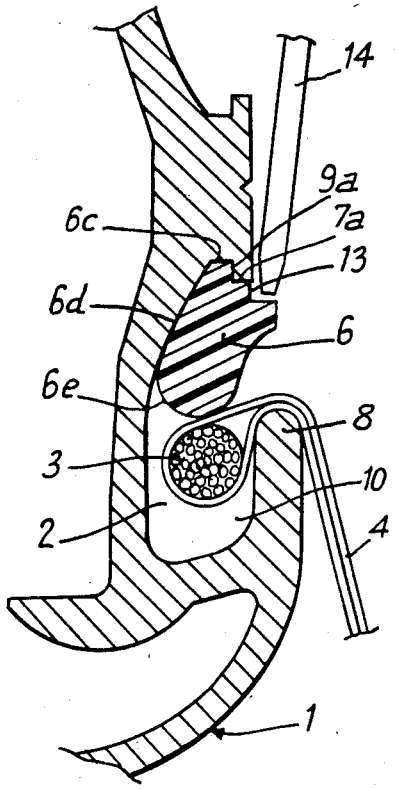
FIG. 5 is a view similar to FIG. 4 of another embodiment of the locking rod 6.

As has been mentioned, in order to free sheet 4 from groove 2 and for this to release bead 3, as well as to facilitate its removal from the second lower channel 10 it is necessary to lower the locking rod 6 in groove 2. To facilitate this operation, in one embodiment of the invention shown in FIG. 5, the locking rod 6 has a second step 13 following the first step 9*a* and projecting from the external side of groove 2. By bearing on this second step 13 with a tool 14 having a point, the locking rod 6 may be readily lowered in groove 2, so as to free its rib 6e from the first channel 9 and so as then to cause it to rotate slightly on itself outwardly, to allow total removal thereof from groove 2.

Figure 6:
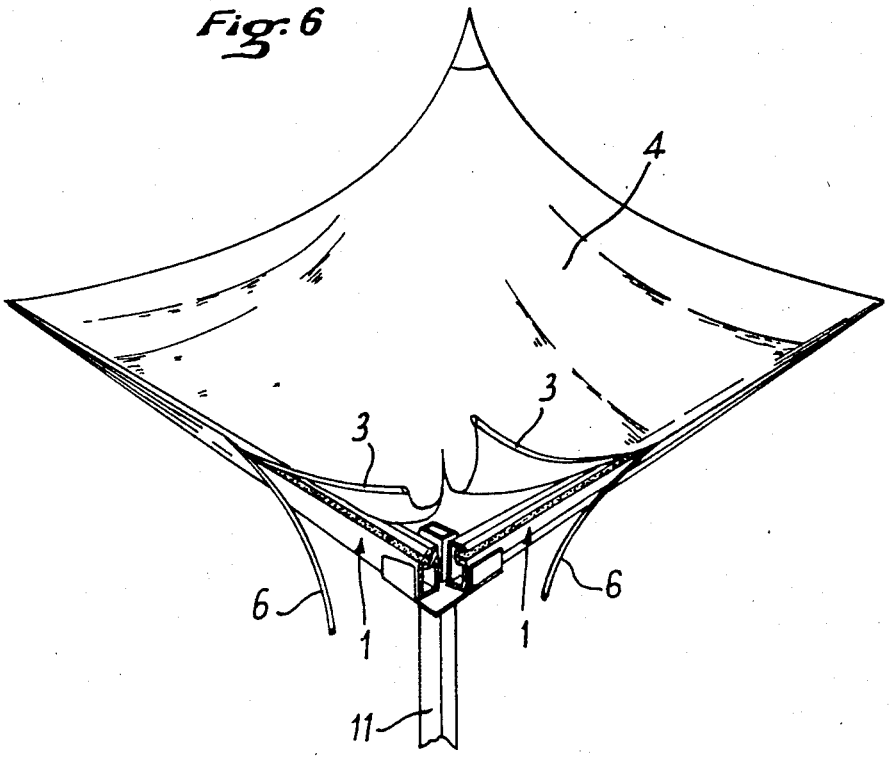
FIG. 6 is a perspective view of a light shelter using a device of the invention for fixing the edge of a canvas.

FIG. 6 illustrates the application of the device of the invention to securing a tent canvas 4 of a light shelter of general pyramidal shape having four sides. In this case, the extruded section 1 forms a square with horizontal base supported by a framework formed of posts 11 and the sections 1 have their grooves 2 opening outwardly. Beads 3 forming the lower edges of the four sides of canvas 4 are secured by engaging the locking rod 6, as has been described above, in the grooves of sections 1.

Figure 7:
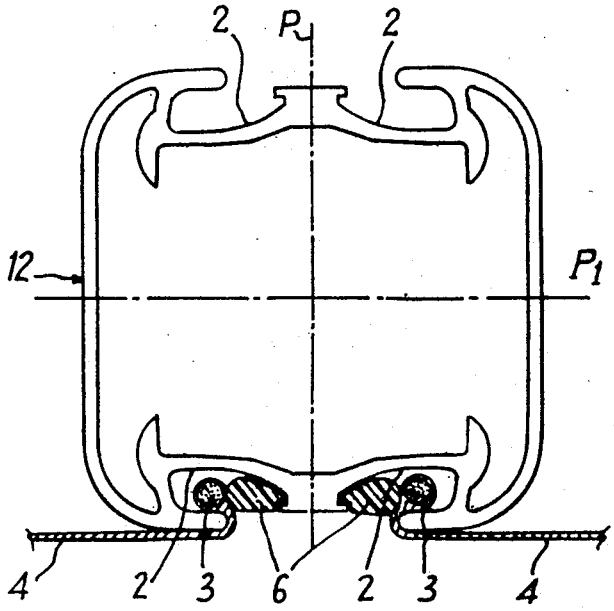
FIG. 7 is a cross sectional view of a variant of the extruded section forming part of the device of the invention for securing the edge of a canvas.

In the variant of the invention shown in FIG. 7, the tubular extruded section 12 with a substantially square cross section, has four grooves 2 divided into two pairs in two opposite lateral faces. Grooves 2 are symmetrical with each other with respect to the two longitudinal planes of symmetry P and P1, perpendicular to each other, of the extruded section. Section 12 may then provide for securing the edges 3 of two coplanar sheets 4, these edges 3 being held locked, by locking rod 6 in the two grooves 2 provided in the same lateral face of the extruded section 12.

What is claimed is:

1. In a device for securing the lower edge of a tent canvas for a light shelter having a general pyramidal shape, the tent canvas having an edge for forming a stretched sheet when held by said device, said device comprising:

a horizontal extruded section having at least one vertical face provided with a groove opening;

said groove opening including an inlet slit with an upper lip and a lower lip, a groove interior comprising a groove bottom forming part of said groove interior for receiving the edge of a tent canvas having said edge for forming the stretched sheet after the edge passes through said inlet slit, said inlet slit having a width smaller than the width of said groove bottom;

a flexible rod engageable transversely in said groove, said sheet cooperating with said flexible rod and having an edge wrapped around said flexible rod forming a bead by being folded back onto itself about said flexible rod to form a double thickness of said sheet; said flexible rod being movable through said slit for engagement with said groove bottom with said bead formed from said double thickness of said sheet extending out of said slit;

a semi-rigid locking rod having one dimension less than the width of said inlet slit and another dimension greater than the width of said inlet slit movable through said inlet slit into said groove interior and rotated so that said greater dimension is above said groove bottom and said flexible rod with said sheet edge folded back onto itself to form said double thickness about said flexible rod for holding said flexible rod and said sheet edge in said groove opening, said sheet edge being positioned between said semi-rigid locking rod and said flexible rod;

said inlet slit including a first upper lip of small height and a second lower lip of large height, said two lips thus defining, rearwardly thereof and on each side of said inlet slit, respectively, on the side of the first upper lip, a first shallow channel and, on the side of the second lower lip, a second deeper channel;

said semi-rigid locking rod having a locked position and an unlocked position and having a thickness along said one dimension less than the width of the said inlet slit so that it can be inserted into said groove opening and having a rib which is jammed, in the locked position of said semi-rigid locking rod, into said first channel, said bead formed by said sheet wrapped around said flexible rod then being forced into and jammed into said second channel below said inlet; and said locking rod extending between said bead and the sheet housed in said second channel and said first channel in a vertical locked position of said locking rod, and when in said vertical locked position being in a vertical position at right angles with respect to its horizontal unlocked insertion position of insertion into said groove opening and extending below said inlet slit to block said bead against said groove bottom;

said locking rod including a lower rounded part for jamming said locking rod against said lower lip for joining together the internal and external faces of said locking rod, so that a tractive force exerted outwardly on the sheet does not allow said bead to escape from said groove opening and move through said inlet slit while at the said time clamping said sheet.

2. The device as claimed in claim 1, wherein the total height between said rib and said lower face of the locking rod is greater than the width of said inlet slit of the said groove opening.

3. The device as claimed in claim 2, wherein in the locked position, the lower face of said locking rod is slightly lower than the upper edge of said lower lip.

4. The device as claimed in claim 1, wherein in said locked position, said locking rod bears by an upper part of its external face against the internal face of said upper lip and bears by the lower part of this same external face against the internal face of the lower lip of said groove opening.

5. The device as claimed in claim 1, wherein said first upper channel is connected to a curved inner face of said groove opening serving for guiding the locking rod so as to cause it to pivot between its horizontal position for insertion into said groove opening and its vertical locking position.

6. The device as claimed in claim 1, wherein said locking rod includes a first step and a second step following said first step on the front side of the top of said groove opening.

7. The device as claimed in claim 1, wherein said horizontal extruded section is tubular, with a substantially square cross section and is provided with four grooves distributed in two pairs in two opposite lateral faces, said last mentioned grooves being symmetrical to each other with respect to two longitudinal planes of symmetry, perpendicular with each other, of said extruded section.

8. The device as claimed in claim 2, wherein in said locked position, said locking rod bears by an upper lip of its external face against the internal face of said upper lip and bears by the lower part of this same external face against the internal face of the lower lip of said groove opening.

9. The device as claimed in claim 4, wherein said horizontal extruded section is tubular, with a substantially square cross section and is provided with four grooves distributed in two pairs in two opposite lateral faces, said last mentioned grooves being symmetrical to each other with respect to two longitudinal planes of symmetry, perpendicular with each other, of said extruded section.

10. The device as claimed in claim 2, wherein said horizontal extruded section is tubular, with a substantially square cross section and is provided with four grooves distributed in two pairs in two opposite lateral faces, said last mentioned grooves being symmetrical to each other with respect to two longitudinal planes of symmetry, perpendicular with each other, of said extruded section.

11. The device as claimed in claim 2, wherein said first upper channel is connected to a curved inner face of said groove opening serving for guiding the locking rod so as to cause it to pivot between its horizontal position for insertion into said groove opening and its vertical locking position.

12. The device as claimed in claim 2, wherein said locking rod includes a second step following a first step on the front side of said groove opening.

13. A light shelter comprising a device for securing the lower edge of a tent canvas to form the light shelter, the light shelter having a general pyramidal shape, the tent canvas having an edge for forming a stretched sheet when held by said device, comprising:

a sheet having an edge folded back upon itself to form a substantially cylindraceous enclosure and a double thickness portion forming a bead;

said securing device comprising a horizontal extruded section having at least one vertical face provided with a groove opening, said groove opening including an inlet slit, a groove interior comprising a groove bottom forming part of said groove interior for receiving the edge of said stretched sheet and said double thickness portion after the edge passes through said inlet slit, said inlet slit having a width smaller than the width of said groove bottom;

a flexible rod engageable transversely in said groove and passing through said cylindraceous enclosure, said sheet edge forming said bead by being folded back onto itself wraps about solely said flexible rod, said flexible rod being movable through said slit with said sheet edge for engagement with said groove bottom with said bead extending out of said slit;

a semi-rigid locking rod movable through said inlet slit into said groove interior above said groove bottom and said flexible rod with said sheet edge folded back onto itself about said flexible rod for holding thereof in said groove opening;

said inlet slit including a first upper lip of small height and a second, lower lip of large height greater than the height of said first, upper lip, said two lips thus defining, rearwardly thereof and on each side of said inlet slit, respectively, on the side of the first upper lip, a first shallow channel and, on the side of the second lower lip, a second deeper channel;

said locking rod having a thickness less than the width of the said inlet slit so that it can be inserted into said groove opening through said inlet slit and having rib means which is jammed, in the locked position of said locking rod, into said first channel, the sheet and said bead then being jammed into said second channel; and said locking rod extending between said bead and the sheet housed in said second channel and said first channel in a locked position of said locking rod, and when in said locked position said locking rod being in a vertical position at right angles with respect to its position of insertion into said groove opening;

said locking rod including a lower rounded part for jamming said locking rod against said lower lip for joining together the internal and external faces of said locking rod, so that a tractive force exerted outwardly on the sheet does not allow said bead to escape from said groove opening to hold said sheet and said flexible rod tightly with said securing device and preventing withdrawal through said inlet slit.

14. The shelter as claimed in claim 13, wherein said semi-rigid locking rod has in cross section a shape complementary to that of the upper part of said groove opening and a lower rounded face such that said locking rod is slightly less than the width of the inlet slit of said groove inlet to leave a small passage through which said double thickness portion of the sheet forming with said flexible rod said bead extends out of said inlet slit.

15. The device as claimed in claim 13, wherein in said locked position, said locking rod bears by an upper part of its external face against the internal face of said upper lip and bears by the lower part of this same external face against the internal face of the lower lip of said groove opening.

16. The device as claimed in claim 13, wherein said first upper channel is connected to a curved inner face of said groove opening serving for guiding the locking rod so as to cause it to pivot between its horizontal position for insertion into said groove opening and its vertical locking position locking said bead to said securing device.

* * * * *